US010625400B2

(12) United States Patent
Kaur et al.

(10) Patent No.: US 10,625,400 B2
(45) Date of Patent: Apr. 21, 2020

(54) NONWOVEN ABRASIVE ARTICLE CONTAINING FORMED ABRASIVE PARTICLES

(71) Applicant: 3M INNOVATIVE PROPERTIES COMPANY, St. Paul, MN (US)

(72) Inventors: Jasmeet Kaur, Atlanta, GA (US); Jacob M. Zwier, River Falls, WI (US); Negus B. Adefris, Woodbury, MN (US); Edward J. Woo, Woodbury, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 14/772,414

(22) PCT Filed: Mar. 4, 2014

(86) PCT No.: PCT/US2014/020106
§ 371 (c)(1),
(2) Date: Sep. 3, 2015

(87) PCT Pub. No.: WO2014/137972
PCT Pub. Date: Sep. 12, 2014

(65) Prior Publication Data

US 2016/0008957 A1 Jan. 14, 2016

Related U.S. Application Data

(60) Provisional application No. 61/772,007, filed on Mar. 4, 2013.

(51) Int. Cl.

| | |
|---|---|
| ***B24D 3/14*** | (2006.01) |
| ***B24D 3/00*** | (2006.01) |
| ***B24D 11/00*** | (2006.01) |

(52) U.S. Cl.
CPC ..... *B24D 3/14* (2013.01); *B24D 3/002* (2013.01); *B24D 11/00* (2013.01)

(58) Field of Classification Search
CPC ..... B24D 11/00; B24D 3/002; B24D 3/14
See application file for complete search history.

(56) References Cited

U.S. PATENT DOCUMENTS 2,958,593 A * 11/1960 Hoover ..... A47L 13/04 451/532
3,626,970 A 12/1971 Jones
(Continued)

FOREIGN PATENT DOCUMENTS

WO WO-9523539 A1 * 9/1995 ..... A46B 13/005
WO 2012/006017 1/2012
(Continued)

OTHER PUBLICATIONS

3M Corp. Apr. 2017 "3M Cubitron Precision Shaped Abrasive Grain", technical document from 3M website detailing prior art product.*

(Continued)

*Primary Examiner* — Marc Carlson
(74) *Attorney, Agent, or Firm* — Katherine M. Scholz; Aleksander Medved; David B. Patchett

(57) ABSTRACT

A nonwoven abrasive article having a nonwoven web and a binder adhering formed ceramic abrasive particles to fibers of the nonwoven web. The formed ceramic abrasive particles having a formed ceramic abrasive particle size and the fibers having a fiber diameter, and wherein a ratio of the formed ceramic abrasive particle size to the nonwoven fiber diameter is from 0.4 to 3.5.

20 Claims, 3 Drawing Sheets

(56) References Cited

U.S. PATENT DOCUMENTS 4,227,350 A 10/1980 Fitzer
5,181,977 A 1/1993 Gneiding
5,201,916 A * 4/1993 Berg ..... B24D 3/14 264/6
5,366,523 A * 11/1994 Rowenhorst ..... B24D 3/14 51/293
5,372,620 A * 12/1994 Rowse ..... C04B 35/1115 423/600
5,591,239 A * 1/1997 Larson ..... A47L 13/16 51/294
RE35,570 E 7/1997 Rowenhorst
5,786,065 A * 7/1998 Annis ..... B24D 11/005 428/141
5,928,070 A * 7/1999 Lux ..... B24D 3/00 451/526
5,942,015 A * 8/1999 Culler ..... B24D 3/28 51/295
5,984,998 A * 11/1999 Ottesen ..... G01N 21/39 75/375
6,017,831 A * 1/2000 Beardsley ..... B24D 3/28 442/148
6,302,930 B1 * 10/2001 Lux ..... B24D 3/004 451/526
6,979,713 B2 * 12/2005 Barber, Jr. ..... B24D 3/344 15/104.001
8,034,137 B2 10/2011 Erickson
8,123,828 B2 * 2/2012 Culler ..... B01J 2/22 51/296
8,142,531 B2 * 3/2012 Adefris ..... C09K 3/1409 428/142
8,142,532 B2 * 3/2012 Erickson ..... C09K 3/1409 51/309
8,142,891 B2 * 3/2012 Culler ..... B24D 11/00 428/402
2004/0253895 A1 12/2004 Castellani
2008/0153407 A1 6/2008 Rambosek
2009/0169816 A1 * 7/2009 Erickson ..... B01J 2/22 428/142
2010/0146867 A1 * 6/2010 Boden ..... B24D 3/00 51/309
2010/0151201 A1 * 6/2010 Erickson ..... C09K 3/1409 428/148
2010/0319269 A1 * 12/2010 Erickson ..... B24D 11/00 51/295
2013/0012112 A1 1/2013 Hsu

FOREIGN PATENT DOCUMENTS

WO 2012/141905 10/2012
WO WO 2012141905 A2 * 10/2012 ..... B24D 3/20

OTHER PUBLICATIONS

3M Corp. Dec. 2010 "3M Cubitron Abrasive Grain", technical document from Internet Archive Wayback Machine of 3M website detailing prior art product.*

* cited by examiner

NONWOVEN ABRASIVE ARTICLE CONTAINING FORMED ABRASIVE PARTICLES

CROSS REFERENCE TO RELATED APPLICATIONS

This application is a national stage filing under 35 U.S.C. 371 of PCT/US2014/020106 filed Mar. 4, 2014, which claims priority to U.S. Provisional Application No. 61/772,007, filed Mar. 4, 2013, the disclosures of which are incorporated by reference in their entirety herein.

BACKGROUND

Nonwoven abrasive articles generally have a nonwoven web (e.g., a lofty open fibrous web), abrasive particles, and a binder material (commonly termed a "binder") that bonds the fibers within the nonwoven web to each other and secures the abrasive particles to the nonwoven web. Examples of nonwoven abrasive articles include nonwoven abrasive hand pads such as those marketed by 3M Company of Saint Paul, Minn. under the trade designation "SCOTCH-BRITE".

Other examples of nonwoven abrasive articles include convolute abrasive wheels and unitized abrasive wheels. Nonwoven abrasive wheels typically have abrasive particles distributed through the layers of nonwoven web bonded together with a binder that bonds layers of nonwoven webs together, and likewise bonds the abrasive particles to the nonwoven web. Unitized abrasive wheels have individual discs of nonwoven web arranged in a parallel fashion to form a cylinder having a hollow axial core. Alternatively, convolute abrasive wheels have a nonwoven web that is spirally wound about and affixed to a core member.

SUMMARY

The material removal rate and resulting finish of nonwoven abrasive articles while using them on a work piece are import performance attributes. For some applications, reducing the resulting surface roughness (finish) on the work piece while maintaining or even increasing the material removal rate of the nonwoven abrasive article in use is very desirable. It was surprisingly found that nonwoven abrasive articles according to the present invention exhibit significant improvements in the total cut, as evaluated according to the test methods disclosed, when compared to alternative nonwoven abrasive articles using crushed abrasive particles as shown in the Examples.

In particular, the ratio of the formed ceramic abrasive particle size to the nonwoven fiber diameter was found to have a surprising effect on the total cut of the nonwoven abrasive article. If the ratio becomes too small the total cut sharply drops off and if the ratio becomes too large the total cut rate again sharply drops off. The result is particularly surprising since control samples having crushed abrasive particles of various sizes and had a fairly uniform total cut independent of abrasive particle size or nonwoven fiber diameter. Thus, only nonwovens using formed ceramic abrasive particles exhibited this unique attribute.

Hence, in one aspect, the invention resides in a nonwoven abrasive article comprising a nonwoven web; a binder adhering formed ceramic abrasive particles to fibers of the nonwoven web; the formed ceramic abrasive particles having a formed ceramic abrasive particle size and the fibers having a fiber diameter; and wherein a ratio of the formed ceramic abrasive particle size to the nonwoven fiber diameter is from 0.3 to 5.0.

BRIEF DESCRIPTION OF THE DRAWINGS

Repeated use of reference characters in the specification and drawings is intended to represent the same or analogous features or elements of the disclosure.

DEFINITIONS

Figure 1A:
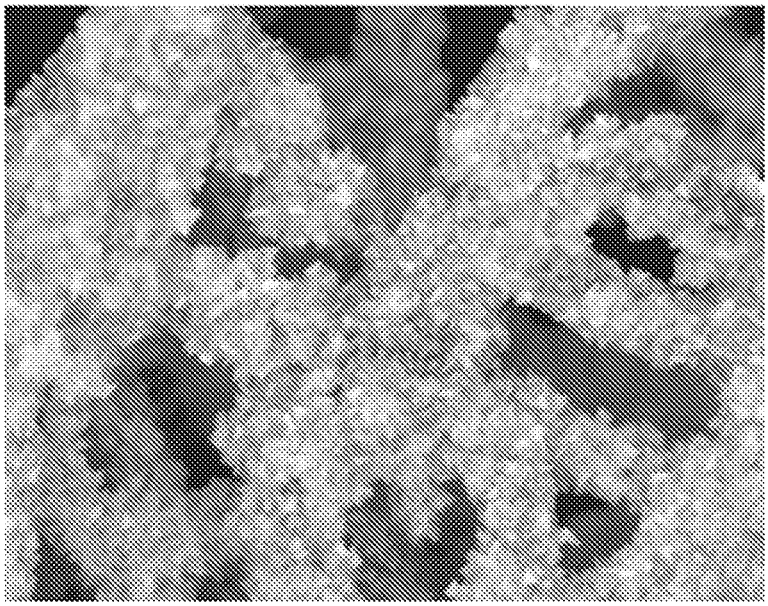
FIG. 1A is a photomicrograph of a nonwoven abrasive having shaped abrasive particles adhered to nonwoven fibers by a binder and having a formed ceramic abrasive particle size to fiber diameter ratio of 0.31.

As used herein, variations of the words "comprise", "have", and "include" are legally equivalent and open-ended. Therefore, additional non-recited elements, functions, steps or limitations may be present in addition to the recited elements, functions, steps, or limitations.

As used herein "formed ceramic abrasive particle" means an abrasive particle having at least a partially replicated shape. One process to make a formed ceramic abrasive particle includes shaping the precursor ceramic abrasive particle in a mold having a predetermined shape to make ceramic shaped abrasive particles. Ceramic shaped abrasive particles, formed in a mold, are one species in the genus of formed ceramic abrasive particles. Other processes to make other species of formed ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. Non-limiting examples of formed ceramic abrasive particles include shaped abrasive particles, such as triangular plates as disclosed in U.S. Pat. Nos. RE 35,570; 5,201,916; 5,984,998; 8,034,137; 8,123,828; 8,142,531; 8,142,532; and 8,142,891; and in U.S. patent publications 2009/0169816, 2010/0146867, and 2010/0319269 or elongated ceramic rods/filaments often having a circular cross section produced by Saint-Gobain Abrasives an example of which is disclosed in U.S. Pat. No. 5,372,620. Formed ceramic abrasive particles are generally homogenous or substantially uniform and maintain their sintered shape without the use of a binder such an organic or inorganic binder that bond smaller abrasive particles into an agglomerated structure and excludes abrasive particles obtained by a crushing or comminution process that produces abrasive particles of random size and shape. In many embodiments, the formed ceramic abrasive particles comprise a homogeneous structure of sintered alpha alumina or consist essentially of sintered alpha alumina

DETAILED DESCRIPTION

Various exemplary abrasive articles according to the present invention, including lofty open nonwoven abrasive articles (e.g., webs and sheets), unitized abrasive wheels, and convolute abrasive wheels, may be manufactured through processes that include steps such as, for example, coating a curable composition, typically in slurry form, on a nonwoven web. In the formation of convolute or unitized abrasive wheels, the nonwoven web is typically compressed (i.e., densified) relative to nonwoven webs used in lofty open nonwoven fiber articles.

In other processes, the nonwoven abrasive article can be made by first forming a nonwoven web, applying a make coat to the nonwoven web, applying formed ceramic abrasive particles to the make coat, curing the make coat and then applying a size coat over the make coat and curing the size coat. Such a process and nonwoven web is disclosed in U.S. Pat. No. 4,227,350 (Fitzer) entitled "Low Density Abrasive Product and Method of Making the Same."

Nonwoven Webs

Nonwoven webs suitable for use in the aforementioned abrasive articles are well known in the abrasives art. Typically, the nonwoven web comprises an entangled web of fibers. The fibers may comprise continuous fiber, staple fiber, or a combination thereof. For example, the nonwoven web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter.

The nonwoven web may be manufactured, for example, by conventional air laid, carded, stitch bonded, spun bonded, wet laid, and/or melt blown procedures. Air laid nonwoven webs may be prepared using equipment such as, for example, that available under the trade designation "RANDO WEBBER" commercially available from Rando Machine Company of Macedon, N.Y.

Nonwoven webs are typically selected to be suitably compatible with adhering binders and abrasive particles while also being processable in combination with other components of the abrasive article, and typically can withstand processing conditions (e.g., temperatures) such as those employed during application and curing of the curable composition. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped, but may also be continuous filaments such as those formed by an extrusion process. Combinations of fibers may also be used.

Prior to impregnation with the curable composition, the nonwoven fiber web typically has a weight per unit area (i.e., basis weight) of at least about 50 grams per square meter (gsm), at least about 100 gsm, or at least about 200 gsm; and/or less than about 400 gsm, less than about 350 gsm, or less than about 300 gsm, as measured prior to any coating (e.g., with the curable composition or optional pre-bond resin), although greater and lesser basis weights may also be used. In addition, prior to impregnation with the curable composition, the fiber web typically has a thickness of at least about 5 mm, at least about 6 mm, or at least about 10 mm; and/or less than about 200 mm, less than about 75 mm, or less than about 30 mm, although greater and lesser thicknesses may also be useful.

Further details concerning nonwoven abrasive articles, abrasive wheels and methods for their manufacture may be found, for example, in U.S. Pat. No. 2,958,593 (Hoover et al.); U.S. Pat. No. 5,591,239 (Larson et al.); U.S. Pat. No. 6,017,831 (Beardsley et al.); and U.S. Pat. No. 6,979,713 (Barber, Jr.).

Frequently, it is useful to apply a prebond resin to the nonwoven web prior to coating with the curable composition. The prebond resin serves, for example, to help maintain the nonwoven web integrity during handling, and may also facilitate bonding of a urethane binder to the nonwoven web. Examples of prebond resins include phenolic resins, urethane resins, hide glue, acrylic resins, urea-formaldehyde resins, melamine-formaldehyde resins, epoxy resins, and combinations thereof. The amount of prebond resin used in this manner is typically adjusted toward the minimum amount consistent with bonding the fibers together at their points of crossing contact. If the nonwoven web includes thermally bondable fibers, thermal bonding of the nonwoven web may also be helpful to maintain web integrity during processing.

In other embodiments, the nonwoven web can be manufactured by the process disclosed in U.S. Pat. No. 4,227,350 and used in the Examples where synthetic organic filament forming material is heated to a molten state and extruded from spinnerets to provide a bundle of free-falling filaments. The filaments free fall through an air space into a quench bath where the coil and undulate at or near the surface of the bath to form an autogenously bonded web. While the web is still sufficiently plastic to be permanently deformed, the web is passed between opposing rollers submerged in the quench bath to consolidate and compress the web's thickness. The web is removed from the quench bath, passed through a drying station, coated with a curable liquid resin binder (make coat), coated with abrasive particles on one or both major surfaces of the web, passed though a curing oven, coated with a second coating of a resin binder (size coat) and passed through a second curing station after which it is converted into various types of abrasive articles such as hand pads, unitized abrasive wheels, or convolute abrasive wheels. See FIGS. 1-6 in U.S. Pat. No. 4,227,350 for further details on the manufacturing process and the resulting abrasive articles formed.

The resulting abrasive article formed by the above described process can comprise a low density abrasive product. The abrasive product has a uniform cross-section of an open, porous, lofty web having at least one layer, each layer having a multitude of continuous three-dimensionally undulated fibers of organic thermoplastic material with adjacent fibers being inter-engaged and autogenously bonded where they touch one another. The abrasive product has a multitude of abrasive particles such as formed ceramic abrasive particles bonded to the fibers of the web by a binder. Suitable organic fiber forming materials include polyamides such as polycaprolactam and polyhexamethylene; polyolefins such as polypropylene and polyethylene; polyesters; and polycarbonate. In some embodiments the yield strength of the fiber forming material is at least 3000 psi. In some embodiments, the fiber diameter is from 5 to 125 mils (127 micrometers to 3.175 mm), or from 10 to 20 mils (254 to 508 micrometers). In another embodiment, the fiber diameter is from 50 to 385 micrometers.

In the event that the nonwoven abrasive article comprises a blend of fibers having two or more different fiber diameters, then the ratio of formed abrasive particle size to the fiber diameter should be satisfied for at least the diameter of the fiber having the largest weight percent in the blend of fibers. In some embodiments, the ratio of formed abrasive particle size to the fiber diameter is satisfied for all fibers contained within the nonwoven abrasive article. In other embodiments, a small weight percentage of the fibers in the nonwoven abrasive article may fall outside of the claimed ratio of formed abrasive particle size to the fiber diameter when used as fillers, strength enhancers, or other adjuncts in the blend and in these embodiments less than 30%, or less than 20%, or less than 10%, or less than 5% but greater than 0% of the fibers in the blend will not satisfy the ratio of the formed abrasive particles size to the fiber diameter.

In some embodiments, the nonwoven abrasive articles can use a fiber having a non-circular cross sectional shape or blends of fibers having a circular and a non-circular cross sectional shape can be used. In the event that the fiber component(s) are of a non-circular cross sectional shape (e.g., triangular, delta, H-shaped, trilobal, rectangular, square, dog bone, ribbon-shaped, oval), the effective fiber diameter for the purposes of the calculation of formed abrasive particle size to fiber diameter ratio is determined by the diameter of the smallest circumscribed circle that can be drawn around the non-circular fiber's cross-section.

Abrasive Particles

Useful abrasive particles for incorporating into the agglomerates of the invention are formed ceramic abrasive particles and, in particular, shaped abrasive particles. Shaped abrasive particles were prepared according to the disclosures of U.S. Pat. No. 8,142,531. The shaped abrasive particles were prepared by shaping alumina sol gel from, for example, equilateral triangle-shaped polypropylene mold cavities of side length 0.031 inch (0.79 mm) and a mold depth of 0.008 inch (0.2 mm). After drying and firing, such resulting shaped abrasive particles comprised triangular plates that were about 280 micrometers (longest dimension) and would pass through a 50-mesh sieve and be retained upon a 60-mesh sieve. In one embodiment, the triangular shaped abrasive particles comprise a first face, an opposing second face connected to the first face by a sidewall where the perimeter of each face is a triangular and desirably an equilateral triangle. In some embodiments, the sidewall, instead of having a 90 degree angle to both faces, is a sloping sidewall as disclosed in U.S. Pat. No. 8,142,531 having a draft angle a between the second face and the sloping sidewall between about 95 degrees to about 130 degrees, which has been determined to greater enhance the cut rate of the triangular shaped abrasive particles.

In addition to shaped abrasive particles, inventive articles may also contain conventional (e.g., crushed) abrasive particles. Examples of useful conventional abrasive particles for blending with the shaped abrasive particles include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof. The abrasive particles may be in the form of, for example, individual particles, agglomerates, composite particles, and mixtures thereof.

The conventional abrasive particles may, for example, have an average diameter of at least about 0.1 micrometer, at least about 1 micrometer, or at least about 10 micrometers, and less than about 2000, less than about 1300 micrometers, or less than about 1000 micrometers, although larger and smaller abrasive particles may also be used. For example, the conventional abrasive particles may have an abrasives industry specified nominal grade. Such abrasives industry accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (i.e., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation.

The formed ceramic abrasive particles can be graded to a nominal screened grade using U.S.A. Standard Test Sieves conforming to ASTM E-11 "Standard Specification for Wire Cloth and Sieves for Testing Purposes." ASTM E-11 proscribes the requirements for the design and construction of testing sieves using a medium of woven wire cloth mounted in a frame for the classification of materials according to a designated particle size. A typical designation may be represented as −18+20 meaning that the formed ceramic abrasive particles pass through a test sieve meeting ASTM E-11 specifications for the number 18 sieve and are retained on a test sieve meeting ASTM E-11 specifications for the number 20 sieve. In one embodiment, the formed ceramic abrasive particles have a particle size such that most of the formed ceramic abrasive particles pass through an 18 mesh test sieve and can be retained on a 20, 25, 30, 35, 40, 45, or 50 mesh test sieve. In various embodiments of the invention, the formed ceramic abrasive particles can have a nominal screened grade comprising: −18+20 (925 μm), −20+25 (780 μm), −25+30 (655 μm), −30+35 (550 μm), −35+40 (463 μm), −40+45 (390 μm), −45+50 (328 μm), −50+60 (275 μm), −60+70 (231 μm), −70+80 (196 μm), −80+100 (165 μm), −100+120 (138 μm), −120+140 (116 μm), −140+170 (98 μm), −170+200 (83 μm), −200+230 (69 μm), −230+270 (58 μm), −270+325 (49 μm), −325+400 (42 μm), −400+450 (35 μm), −450+500 (29 μm), or −500+635 (23 μm).

For the purposes of calculating the formed ceramic abrasive particle size to fiber diameter ratio discussed later herein, the above grades for abrasive particles have been assigned an average particle size. The average particle size is the expected average size of abrasive particles conforming to the industry specified grade or in the case of sieves, the average between the size of the screen opening the particle passed through and the size of the screen opening the particle was retained on. The number in parenthesis following the grade or screen designation is the average abrasive particle size in μm and is to be used in the ratio calculation.

Filler particles such as conventional abrasive particles may be blended with formed ceramic abrasive particles in the abrasive article. Examples of useful fillers for this invention include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, aluminum trihydrate, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides.

Typical nonwoven abrasive articles comprise at least 50 wt. % formed ceramic abrasive particles as a weight percentage of the abrasive particles and filler particles applied to the web. For best results, the formed ceramic abrasive particle content is from 50 wt. %, 60 wt. %, 70 wt. %, 80 wt. %, 90 wt. %, 95 wt. % to 100 wt. %. In some embodiments, the formed ceramic abrasive particle size is from 120 micrometers to 1020 micrometers.

Nonwoven Abrasive Articles

The nonwoven abrasive web is prepared by adhering the formed ceramic abrasive particles to a nonwoven web with a curable second binder. Typically, the coating weight for the formed ceramic abrasive particles may depend, for example, on the particular binder used, the process for applying the formed ceramic abrasive particles, and the size of the formed ceramic abrasive particles. For example, the coating weight of the formed ceramic abrasive particles on the nonwoven web (before any compression) may be at least 100 grams per square meter (gsm), at least 600 gsm, or at least 800 gsm; and/or less than 2000 gsm, less than about 1600 gsm, or less than about 1200 gsm, although greater or lesser coating weights may be also be used.

Binders useful for adhering the formed ceramic abrasive particles to the nonwoven web are known in the art and are selected according to the final product requirements. Typical binders include those comprising polyurethane, phenolic, acrylate, and blends of phenolic and acrylate.

As will be discussed later in the Examples, the inventors have discovered that for formed ceramic abrasive particles, such as shaped abrasive particles, the ratio of the formed ceramic abrasive particles size to the nonwoven fiber diameter has been surprisingly found to affect the total cut of the abrasive article. Such a finding is unexpected since prior empirical experience with crushed abrasive particles has not revealed such a dependency. And, in fact, the Control Examples confirm that for crushed abrasive particles the ratio of the abrasive particle size to the nonwoven fiber diameter has no effect on total cut. In various embodiments of the invention, the ratio of formed ceramic abrasive particle size in μm to the nonwoven fiber diameter in μm is from 0.4 to 3.5, or from 0.5 to 2.25, or from 0.7 to 1.5. The average size of the abrasive particles in μm based on its grade or screen cut is divided by the measured diameter of the fiber in μm.

Figure 1B:
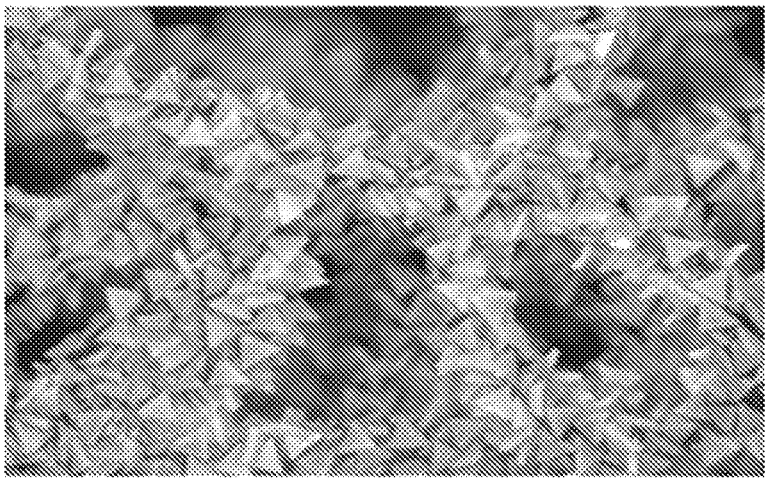
FIG. 1B is a photomicrograph of a nonwoven abrasive having shaped abrasive particles adhered to nonwoven fibers by a binder and having a formed ceramic abrasive particle size to fiber diameter ratio of 0.73.
Figure 1C:
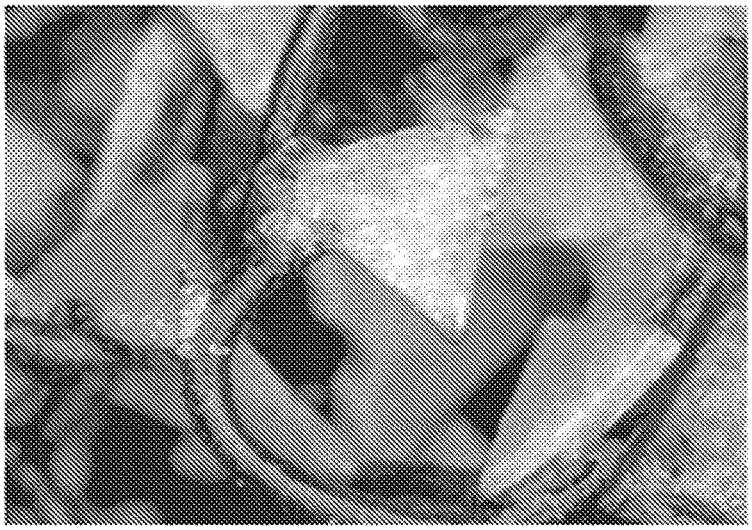
FIG. 1C is a photomicrograph of a nonwoven abrasive having shaped abrasive particles adhered to nonwoven fibers by a binder and having a formed ceramic abrasive particle size to fiber diameter ratio of 4.86.
Figure 2:
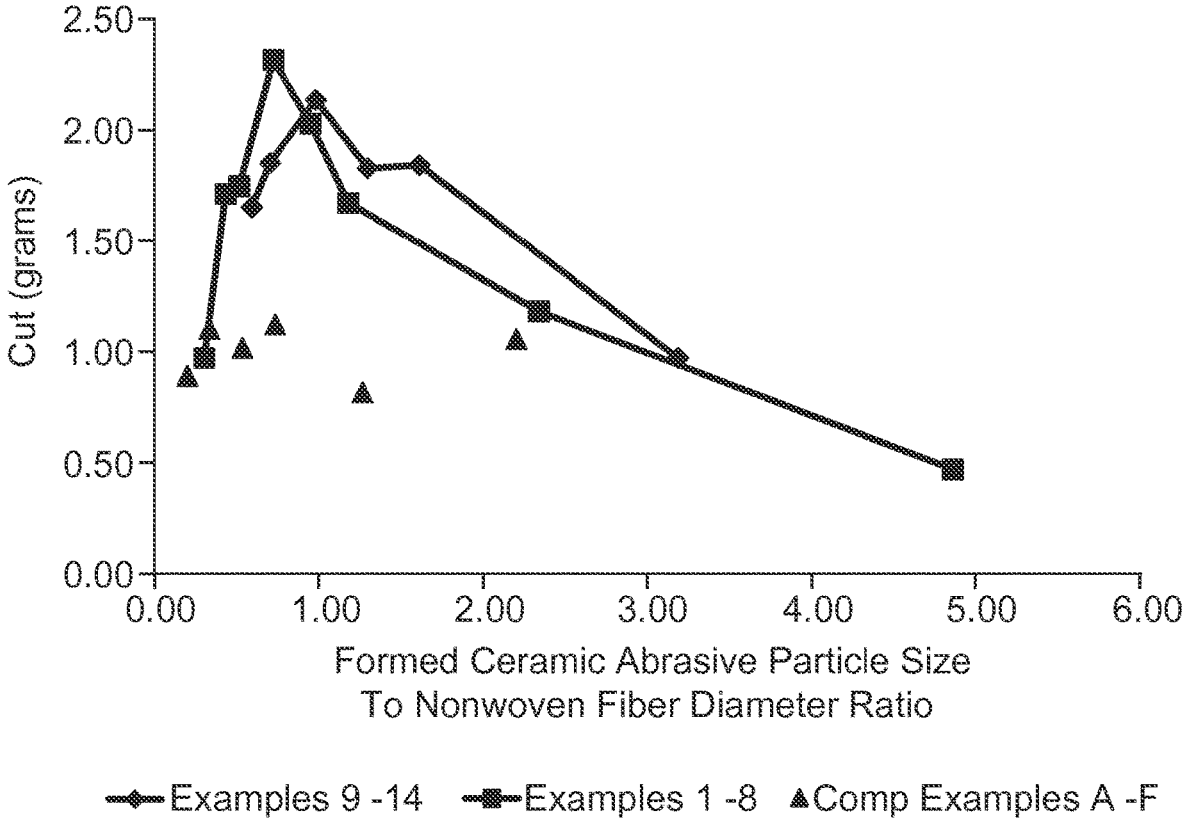
FIG. 2 is a graph plotting Total Cut versus abrasive particle size to fiber diameter ratio for nonwoven abrasive articles having shaped abrasive particles as compared to nonwoven abrasive articles having crushed abrasive particles.
Figure 3:
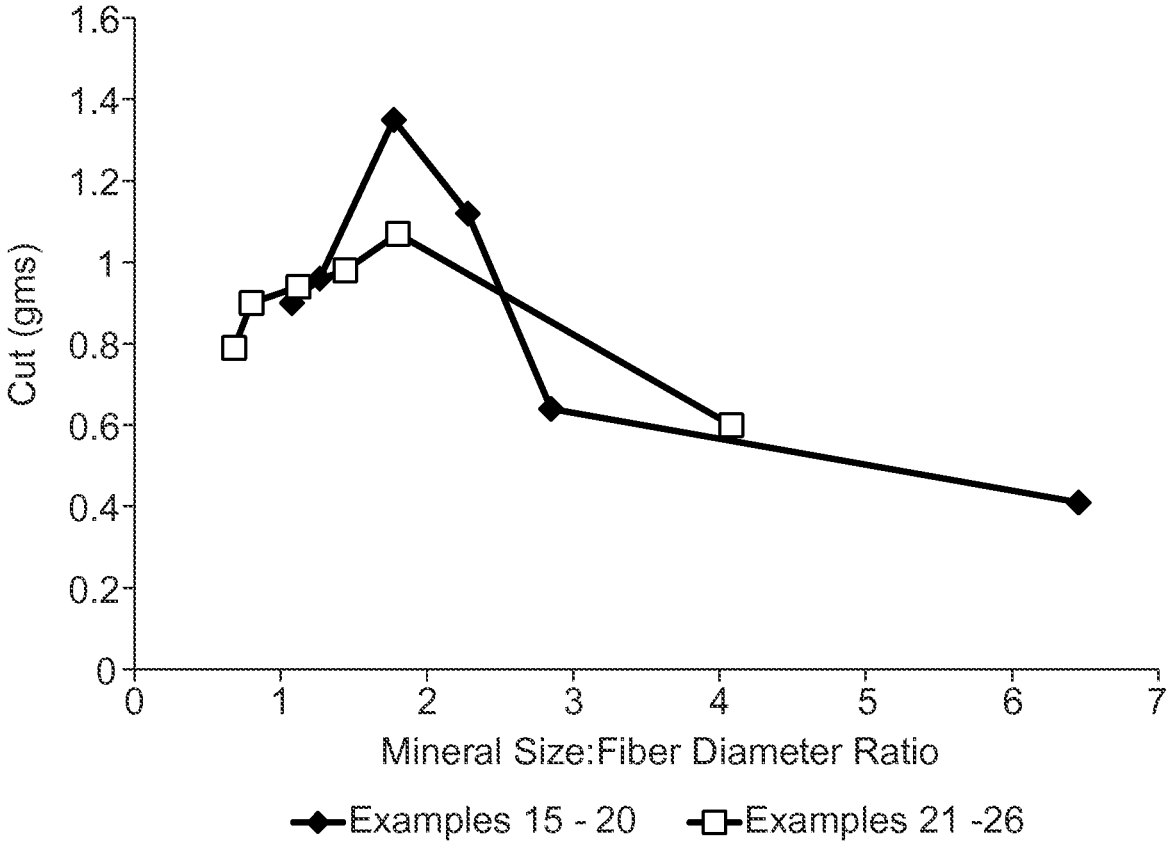
FIG. 3 is a graph plotting Total Cut versus abrasive particle size to fiber diameter ratio for staple fiber-based nonwoven abrasive articles having shaped abrasive particles.

Referring now to FIGS. 1A- to 1C various nonwoven abrasive articles having shaped abrasive particles adhered to the fibers of a nonwoven web with a binder are illustrated. In FIG. 1A, the ratio of formed ceramic abrasive particle size to the nonwoven fiber diameter is 0.31 and the total cut as tested by the Cut Test was 0.97 grams. This sample performed at about the same total cut as nonwoven abrasive articles using crushed abrasive particles. It is believed that the smaller triangular shaped abrasive particles packed together much more tightly on the fibers therefore leaving less sharp edges of the triangles exposed and reducing the total cut. In FIG. 1B, the ratio of formed ceramic abrasive particle size to the nonwoven fiber diameter is 0.73 and the total cut as tested by the Cut Test was 2.31 grams. This sample had approximately 2.25 times the cut of the comparative samples using crushed abrasive particles. It is believed that the medium sized triangular shaped abrasive particles packed together at an optimum density on the fibers therefore tending to "stand the triangular abrasive particles up" leaving the sharp edges of the triangles exposed and increasing the total cut. In FIG. 1C, the ratio of formed ceramic abrasive particle size to the nonwoven fiber diameter is 4.86 and the total cut as tested by the Cut Test was 0.47 grams. This sample had less total cut than nonwoven abrasive articles using crushed abrasive particles even though the abrasive particles were much larger in size. It is believed that the large sized triangular shaped abrasive particles packed together at too low of a density on the fibers therefore tending to lay down on the fibers leaving the flat sides of the triangles exposed and decreasing the total cut.

Nonwoven abrasive articles of the invention may take any of a variety of conventional forms. Preferred nonwoven abrasive articles are in the form of wheels. Nonwoven abrasive wheels are typically in the form of a disc or right cylinder having dimensions that may be very small, e.g., a cylinder height on the order of a few millimeters or very large, e.g., a meter or more, and a diameter which may be very small, e.g., on the order of a few centimeters, or very large, e.g., tens of centimeters. Wheels typically have a central opening for support by an appropriate arbor or other mechanical holding means to enable the wheels to be rotated during use. Wheel dimensions, configurations, means of support, and means of rotation are all well known in the art.

Convolute abrasive wheels may be provided, for example, by winding the nonwoven web that has been impregnated with the curable composition under tension around a core member (e.g., a tubular or rod-shaped core member) such that the impregnated nonwoven layers become compressed, and then curing the curable composition to provide, in one embodiment, a binder binding the formed ceramic abrasive particles to the nonwoven fibers and binding layers of the nonwoven webs to each other. An exemplary convolute abrasive wheel is where a binder on the web is cured such that the nonwoven web is spirally wound around and affixed to a core member and cured to maintain a circular shape. If desired, convolute abrasive wheels may be dressed prior to use to remove surface irregularities, for example, using methods known in the abrasive arts.

An exemplary unitized abrasive wheel can be provided, for example, by layering the binder impregnated nonwoven web (e.g., as a layered continuous web or as a stack of sheets or even circular disks having a central hole) compressing the nonwoven layers, and curing the curable binder (e.g., using heat). In compressing the layers of nonwoven web, the layers are typically compressed to form a bun having a density that is from 1 to 20 times that of the density of the layers in their non-compressed state. The bun is then typically subjected to heat molding (e.g., for from 2 to 20 hours) at elevated temperature (e.g., at 135° C.), typically depending on the binder, for example, urethane and bun size.

EXAMPLES

Objects and advantages of this disclosure are further illustrated by the following non-limiting examples. The particular materials and amounts thereof recited in these examples as well as other conditions and details, should not be construed to unduly limit this disclosure. Unless otherwise noted, all parts, percentages, ratios, etc. in the Examples and the rest of the specification are by weight.

TABLE 1

Materials

| Abbreviation | Description |
|---|---|
| BL-16 | Polyurethane prepolymer, obtained from Chemtura Group, Middlebury, Connecticut as "ADIPRENE BL-16" |
| BL-31 | Polyurethane prepolymer, obtained from Chemtura Group, Middlebury, Connecticut as "ADIPRENE BL-31" |
| K450 | Aromatic amine curing agent, "LAPOX K-450", obtained from Royce International, East Rutherford, New Jersey |
| Clay | Bentonite Clay powder clay sold under the trade name "Volcay 325" by American Colloid Company, Arlington Heights, Illinois |
| PMA | Propylene glycol monomethyl ether acetate, "DOWANOL PMA 484431", obtained from Sigma Aldrich, St. Louis, Missouri |
| LiSt | Lithium stearate lubricant, obtained from Ashland, Inc., Covington, Kentucky as "LIC17" |
| PMX | a premix of 44% LiSt and 56% PMA |
| VM | Viscosity Modifier, available as "CAB-O-SIL Untreated Fumed Silica, M-5" from Cabot Corporation, Cab-O-Sil division, Tuscola, Illinois |
| Z-6040 | Glycidoxypropyltrimethoxy silane coupling agent, available as "Z-6040" from Dow Corning, Midland, Michigan |
| solvent | Xylol "Xylene", obtained from CITGO petroleum corporation, Rolling Meadows, Illinois |

TABLE 1-continued

Materials

| Abbreviation | Description |
|---|---|
| Pigment | "Raven 16" Carbon Black Pigment obtained from Columbian Chemicals Company St. Louis, MO |
| SAP1 | Triangular ceramic alumina particle that passes through a 10-mesh sieve and is retained upon a 12-mesh sieve, which gives an average particle size of 0.073 in (1.85 mm). |
| SAP2 | Triangular ceramic alumina particle that passes through a 16-mesh sieve and is retained upon a 20-mesh sieve, which gives an average particle size of 0.040 in (1.02 mm). |
| SAP3 | Triangular ceramic alumina particle that passes through a 30-mesh sieve and is retained upon a 50-mesh sieve, which gives an average particle size of 0.018 in (0.45 mm). |
| SAP4 | Triangular ceramic alumina particle that passes through a 40-mesh sieve and is retained upon a 50-mesh sieve, which gives an average particle size of 0.014 in (0.36 mm). |
| SAP5 | Triangular ceramic alumina particle that passes through a 50-mesh sieve and is retained upon a 60-mesh sieve, which gives an average particle size of 0.011 in (0.28 mm). |
| SAP6 | Triangular ceramic alumina particle that passes through a 70-mesh sieve and is retained upon a 80-mesh sieve, which gives an average particle size of 0.20 mm. |
| SAP7 | Triangular ceramic alumina particle that passes through a 80-mesh sieve and is retained upon a 100-mesh sieve, which gives an average particle size of 0.007 in (0.17 mm). |
| SAP8 | Triangular ceramic alumina particle that passes through a 120-mesh sieve and is retained upon a 140-mesh sieve, which gives an average particle size of 0.005 in (0.12 mm). |
| AP1 | grade 24 ceramic alumina crushed mineral, average particle size of 0.033 in (0.84 mm), obtained as "3M ™ Ceramic Abrasive Grain 222" from 3M, Saint Paul, Minnesota |
| AP2 | grade 40 ceramic alumina crushed mineral, average particle size of 0.019 in (0.48 mm, obtained as "3M ™ Ceramic Abrasive Grain 222" from 3M, Saint Paul, Minnesota) |
| AP3 | grade 60 ceramic alumina crushed mineral, average particle size of 0.011 in (0.28 mm), obtained as "3M ™ Ceramic Abrasive Grain 222" from 3M, Saint Paul, Minnesota |
| AP4 | grade 80 ceramic alumina crushed mineral, average particle size of 0.008 in (0.20 mm), obtained as "3M ™ Ceramic Abrasive Grain 222" from 3M, Saint Paul, Minnesota |
| AP5 | grade 120 ceramic alumina crushed mineral, average particle size of 0.005 in (0.13 mm), obtained as "3M ™ Ceramic Abrasive Grain 222" from 3M, Saint Paul, Minnesota |
| AP6 | grade 220 ceramic alumina crushed mineral, average particle size of 0.003 in (0.08 mm), obtained as "3M ™ Ceramic Abrasive Grain 222" from 3M, Saint Paul, Minnesota |

Cut Test

A four inch (10.16 cm) diameter nonwoven abrasive disc to be tested were mounted on an electric rotary tool that was disposed over an X-Y table having 11 die rule steel blades measuring 3 inches×1 inch×0.625 inch (76 mm×25 mm×16 mm) secured to the X-Y table so that the blades extended 3 inches (76 mm) in the X direction and 0.625 inch (16 mm) in the Y direction with 0.5 inch (13 mm) spacing between the blades in the Y direction. The tool was then set to traverse a 5-inch (127 mm) path at a rate of 2.00 inches/second (51 mm/sec) in the +Y direction; followed by a 0.0077-inch (0.20 mm) path in the +X direction at a rate of 4.00 inches/second (102 mm/sec); followed by a 5-inch (127 mm) path at a rate of 2.00 inches/second (51 mm/sec) in the −Y direction; followed a 0.007-inch (0.20 mm) path in the +X direction at a rate of 4.00 inches/second (102 mm/sec). This sequence was repeated 19 times for a total of 40 passes in the Y direction. The rotary tool was then activated to rotate at 3750 rpm under no load. The abrasive article was then urged radially against the blades at a load of 2.8 lbs (1.27 kg) with its axis of rotation parallel to the X direction. The tool was then activated to move through the prescribed path. The mass of the blades were measured before and after each test to determine the total mass loss in grams. Each example was tested twice (2 articles per example) to determine the reproducibility of the test results.

Abrasive Article Preparation

Examples 1-8

Abrasive articles of Example 1 through Example 8 were prepared using a nonwoven web having 0.015 in (0.38 cm) diameter filaments and shaped abrasive particles of various sizes.

Example 1

A continuous filament nonwoven web was made similarly to that of Example 1 of U.S. Pat. No. 4,227,350. Polycaprolactam (Nylon 6, available commercially under the trade designation "B27 E" from BASF Corporation, Polymers Division of Mt. Olive, N.J.) was extruded at a pressure of 2800 psi ($1.93\times10^4$ kPa) through a 60-inch long (1.52 meter) spinneret having about 2890 counter sunk, counter bored openings arranged in eight equal rows spaced 0.080 inch (0.2 cm) apart in a hexagonal close packed array, each opening having a diameter of 0.016 inch (0.406 mm) and having a land length of 0.079 inch (2.01 mm). The spinneret was heated to about 248° C. and positioned about 7 inches (17.78 cm) above the surface of a quench bath which was continuously filled and flushed with tap water at the rate of about 0.5 gallon per minute (about 2 liters/minute). Filaments extruded from the spinneret were permitted to fall into the quench bath where they undulated and coiled between 4 inch (10.16 cm) diameter, 60 inch (1.52 m) long smooth-surfaced rolls. Both rolls were positioned in the bath with their axes of rotation about 2 inches (5.1 cm) below the surface of the bath, and the rolls were rotated in opposite directions at a rate of about 9 feet/minute (2.74 m/minute) surface speed. The rolls were spaced to lightly compress the surfaces of the resultant extruded web, providing a flattened but not densified surface on both sides. The polymer was extruded at a rate of about 700 lb./hr. (318 kg/hr.), producing a 59 inches wide, 0.66 inch thick (1.50 m wide×16 8 mm thick) web having 8 rows of coiled, undulated filaments. The resulting web weighed about 14.8 g/24 $in^2$ (0.956 $kg/m^2$) and had a void volume of about 95%. The filament diameter averaged about 0.38 cm (0.015 in). The web was carried from the quench bath around one of the rolls and excess water was removed from the web by drying with a room temperature (about 23° C.) air blast. Web weights and filament diameters were varied by the adjustment of roll speed, air space for filament free-fall, and extruder output to produce the examples.

The dried web thus formed was later converted to an abrasive composition by applying a binder resin coating, mineral coating, and size coating. The binder resin coating contained the ingredients shown in Table 2 and was applied via a 2-roll coater. Following the application of the binder resin coating to achieve about 93 grains/24 $in^2$ (0.39 $kg/m^2$) dry add-on, SAP1 was then applied to the resin coated web via a drop coater to achieve an add-on of 590 grains/24 $in^2$ (2.47 $kg/m^2$). The composition was then passed through a curing oven heated at 174° C. to provide a residence time of about 6 minutes to substantially cure the binder resin.

TABLE 2

| Make Resin Components | % of Component |
|---|---|
| BL-16 | 40.7% |
| Solvent | 28.5% |
| K-450 | 15.0% |
| Pigment | 0.9% |
| Clay | 13.3% |
| VM | 1.2% |
| Z-6040 | 0.9% |

A size coating of the composition shown in Table 3 was then sprayed on the top side of the composition and heated in an oven for 6 minutes at 163° C. The composition was inverted and the other side sprayed with an identical amount of the size coating and heated in an oven for 6 minutes at 163° C. The final size coating dry add-on was about 0.53 $kg/m^2$ (126 grains/24 $in^2$). The resulting composition had a thickness of 0.7250 in (1.84 cm) and weighed 1056 grains/24 $in^2$ (4.42 $kg/m^2$). These compositions were then converted into wheels with a diameter of 4 in (10.16 cm) and a center hole of 0.5 in (1.27 cm) for cut testing according to the Cut Test.

TABLE 3

| Size Resin Components | % of Component |
|---|---|
| BL-16 | 29.9% |
| BL-31 | 29.9% |
| solvent | 9.9% |
| K-450 | 24.7% |
| Z-6040 | 0.7% |
| PMX | 5.0% |

Example 2

The abrasive article of Example 2 was prepared using the procedure described for Example 1 except a make coat add-on of 105 grains/24 $in^2$ (0.44 $kg/m^2$), SAP1 was replaced by SAP2 and applied to achieve an abrasive particle coating weight of 573 grains/24 $in^2$ (2.40 $kg/m^2$), and the final size coating dry add-on was about 123 grains/24 $in^2$ (0.51 $kg/m^2$).

Example 3

The abrasive article of Example 3 was prepared using the procedure described for Example 1 except a make coat add-on of 110 grains/24 $in^2$ (0.46 $kg/m^2$), SAP1 was replaced by SAP3 and applied to achieve an abrasive particle coating weight of 579 grains/24 $in^2$ (2.42 $kg/m^2$), and the final size coating dry add-on was about 132 grains/24 $in^2$ (0.55 $kg/m^2$).

Example 4

The abrasive article of Example 4 was prepared using the procedure described for Example 1 except a make coat add-on of 113 grains/24 $in^2$ (0.47 $kg/m^2$), SAP1 was replaced by SAP4 and applied to achieve an abrasive particle coating weight of 740 grains/24 $in^2$ (3.10 $kg/m^2$), and the final size coating dry add-on was about 127 grains/24 $in^2$ (0.53 $kg/m^2$).

Example 5

The abrasive article of Example 5 was prepared using the procedure described for Example 1 except a make coat add-on of 107 grains/24 $in^2$ (0.45 $kg/m^2$), SAP1 was replaced by SAP5 and applied to achieve an abrasive particle coating weight of 614 grains/24 $in^2$ (2.57 $kg/m^2$), and the final size coating dry add-on was about 137 grains/24 $in^2$ (0.57 $kg/m^2$).

Example 6

The abrasive article of Example 6 was prepared using the procedure described for Example 1 except a make coat add-on of 115 grains/24 $in^2$ (0.48 $kg/m^2$), SAP1 was replaced by SAP6 and applied to achieve an abrasive particle coating weight of 633 grains/24 $in^2$ (2.65 $kg/m^2$), and the final size coating dry add-on was about 138 grains/24 $in^2$ (0.58 $kg/m^2$).

Example 7

The abrasive article of Example 7 was prepared using the procedure described for Example 1 except a make coat add-on of 115 grains/24 $in^2$ (0.48 $kg/m^2$), SAP1 was replaced by SAP7 and applied to achieve an abrasive particle coating weight of 618 grains/24 $in^2$ (2.59 $kg/m^2$), and the final size coating dry add-on was about 139 grains/24 $in^2$ (0.58 $kg/m^2$).

Example 8

The abrasive article of Example 8 was prepared using the procedure described for Example 1 except a make coat add-on of 88 grains/24 $in^2$ (0.37 $kg/m^2$), SAP1 was replaced by SAP8 and applied to achieve an abrasive particle coating weight of 614 grains/24 $in^2$ (2.57 $kg/m^2$), and the final size coating dry add-on was about 116 grains/24 $in^2$ (0.49 $kg/m^2$).

Examples 9-14

Abrasive articles of Example 9 through Example 14 were prepared using a nonwoven web having 0.011 in (0.279 cm) diameter filaments and shaped abrasive particles of various sizes.

Example 9

A continuous filament nonwoven web of Example 9 was made as that of Example 1 except that the spinneret was positioned about 9.5 in (241 mm) above the surface of the quench bath. The web thus produced had a filament diameter averaging 0.011 inch (0.279 mm).

The abrasive article of Example 9 was prepared using this modified web and the procedure described for Example 1 except a make coat add-on of 98 grains/24 $in^2$ (0.41 $kg/m^2$), SAP1 was replaced by SAP2 and applied to achieve an abrasive particle coating weight of 537 grains/24 $in^2$ (2.25 k g/$m^2$), and the final size coating dry add-on was about 133 grains/24 $in^2$ (0.56 $kg/m^2$).

Example 10

The abrasive article of Example 10 was prepared using the procedure described for Example 9 except a make coat add-on of 88 grains/24 $in^2$ (0.37 $kg/m^2$), SAP2 was replaced by SAP3 and applied to achieve an abrasive particle coating weight of 623 grains/24 $in^2$ (2.61 $kg/m^2$), and the final size coating dry add-on was about 117 grains/24 $in^2$ (0.49 $kg/m^2$).

Example 11

The abrasive article of Example 11 was prepared using the procedure described for Example 9 except a make coat add-on of 88 grains/24 $in^2$ (0.37 $kg/m^2$), SAP2 was replaced by SAP4 and applied to achieve an abrasive particle coating weight of 607 grains/24 $in^2$ (2.54 $kg/m^2$), and the final size coating dry add-on was about 116 grains/24 $in^2$ (0.49 $kg/m^2$).

Example 12

The abrasive article of Example 12 was prepared using the procedure described for Example 9 except a make coat add-on of 95 grains/24 $in^2$ (0.40 $kg/m^2$), SAP2 was replaced by SAP5 and applied to achieve an abrasive particle coating weight of 504 grains/24 $in^2$ (2.11 $kg/m^2$), and the final size coating dry add-on was about 178 grains/24 $in^2$ (0.74 $kg/m^2$).

Example 13

The abrasive article of Example 13 was prepared using the procedure described for Example 9 except a make coat add-on of 88 grains/24 $in^2$ (0.37 $kg/m^2$), SAP2 was replaced by SAP6 and applied to achieve an abrasive particle coating weight of 671 grains/24 $in^2$ (2.81 $kg/m^2$), and the final size coating dry add-on was about 117 grains/24 $in^2$ (0.49 $kg/m^2$).

Example 14

The abrasive article of Example 14 was prepared using the procedure described for Example 9 except a make coat add-on of 88 grains/24 $in^2$ (0.37 $kg/m^2$), SAP2 was replaced by SAP7 and applied to achieve an abrasive particle coating weight of 609 grains/24 $in^2$ (2.55 $kg/m^2$), and the final size coating dry add-on was about 118 grains/24 $in^2$ (0.49 $kg/m^2$).

Comparative Examples A-F

Abrasive articles of Comparative Example A through Comparative Example F were prepared using nonwoven web having 0.015 in (0.38 cm) diameter filaments and conventional abrasive particles of various sizes.

Comparative Example A

The abrasive article of Comparative Example A was prepared using the procedure described for Example 1 except a make coat add-on of 98 grains/24 $in^2$ (0.41 $kg/m^2$), SAP1 was replaced by AP1 and applied to achieve an abrasive particle coating weight of 546 grains/24 $in^2$ (2.29 $kg/m^2$), and the final size coating dry add-on was about 133 grains/24 $in^2$ (0.56 $kg/m^2$).

Comparative Example B

The abrasive article of Comparative Example B was prepared using the procedure described for Example 1 except a make coat add-on of 109 grains/24 $in^2$ (0.46 $kg/m^2$), SAP1 was replaced by AP2 and applied to achieve an abrasive particle coating weight of 392 grains/24 $in^2$ (1.64 $kg/m^2$), and the final size coating dry add-on was about 74 grains/24 $in^2$ (0.31 $kg/m^2$).

Comparative Example C

The abrasive article of Comparative Example C was prepared using the procedure described for Example 1 except a make coat add-on of 108 grains/24 $in^2$ (0.45 $kg/m^2$), SAP1 was replaced by AP3 and applied to achieve an abrasive particle coating weight of 362 grains/24 $in^2$ (1.52 $kg/m^2$), and the final size coating dry add-on was about 109 grains/24 $in^2$ (0.46 $kg/m^2$).

Comparative Example D

The abrasive article of Comparative Example D was prepared using the procedure described for Example 1 except a make coat add-on of 109 grains/24 $in^2$ (0.46 $kg/m^2$), SAP1 was replaced by AP4 and applied to achieve an abrasive particle coating weight of 407 grains/24 $in^2$ (1.70 $kg/m^2$), and the final size coating dry add-on was about 78 grains/24 $in^2$ (0.33 $kg/m^2$).

Comparative Example E

The abrasive article of Comparative Example E was prepared using the procedure described for Example 1 except a make coat add-on of 93 grains/24 $in^2$ (0.39 $kg/m^2$), SAP1 was replaced by AP5 and applied to achieve an abrasive particle coating weight of 558 grains/24 $in^2$ (2.34 $kg/m^2$), and the final size coating dry add-on was about 121 grains/24 $in^2$ (0.51 $kg/m^2$).

Comparative Example F

The abrasive article of Comparative Example F was prepared using the procedure described for Example 1 except a make coat add-on of 98 grains/24 $in^2$ (0.41 $kg/m^2$), SAP1 was replaced by AP6 and applied to achieve an abrasive particle coating weight of 511 grains/24 $in^2$ (2.14 $kg/m^2$), and the final size coating dry add-on was about 134 grains/24 $in^2$ (0.56 $kg/m^2$).

Discussion of Test Results

For each example, the ratio of formed abrasive particle size to the nonwoven fiber diameter was calculated and reported in Table 4 and Table 5 using particle sizes previously assigned. All examples were tested according to the Cut Test procedure and the cut results are shown in Tables 4 and 5.

As can be seen in Table 4, there is a relationship between the ratio of formed abrasive particle size to the nonwoven fiber diameter and the total cut performance. This relationship is graphically illustrated in FIG. 2.

As can be seen in Table 5, no relationship between the ratio of industry standard crushed abrasive particle size to the nonwoven fiber diameter and total cut performance. The crushed particle data are also illustrated graphically in FIG. 2. When comparing the Examples 1-14 to the Comparative Examples A-F, the impact of the abrasive particle size to the nonwoven fiber diameter on product performance is only seen in the Examples 1-14, i.e., those coated with shaped abrasive particles.

TABLE 4

| Example | Mineral | Mesh Size (ASTM) | Make add-on ($kg/m^2$) | Mineral add-on ($kg/m^2$) | Size add-on ($kg/m^2$) | Fiber Diameter (mm) | SAP Average Size (mm) | Ratio | Cut |
|---|---|---|---|---|---|---|---|---|---|
| 1 | SAP1 | 10/12 | 0.39 | 2.47 | 0.53 | 0.381 | 1.85 | 4.86 | 0.47 |
| 2 | SAP2 | 16/20 | 0.44 | 2.40 | 0.51 | 0.381 | 1.02 | 2.68 | 1.18 |
| 3 | SAP3 | 30/50 | 0.46 | 2.42 | 0.55 | 0.381 | 0.45 | 1.18 | 1.67 |
| 4 | SAP4 | 40/50 | 0.47 | 3.10 | 0.53 | 0.381 | 0.36 | 0.94 | 2.03 |
| 5 | SAP5 | 50/60 | 0.45 | 2.57 | 0.57 | 0.381 | 0.28 | 0.73 | 2.31 |
| 6 | SAP6 | 70/80 | 0.48 | 2.65 | 0.58 | 0.381 | 0.20 | 0.52 | 1.75 |
| 7 | SAP7 | 80/100 | 0.48 | 2.59 | 0.58 | 0.381 | 0.17 | 0.45 | 1.71 |
| 8 | SAP8 | 120/140 | 0.37 | 2.57 | 0.49 | 0.381 | 0.12 | 0.31 | 0.97 |
| 9 | SAP2 | 16/20 | 0.41 | 2.25 | 0.56 | 0.279 | 1.02 | 3.65 | 0.97 |
| 10 | SAP3 | 30/50 | 0.37 | 2.61 | 0.49 | 0.279 | 0.45 | 1.61 | 1.84 |
| 11 | SAP4 | 40/50 | 0.37 | 2.54 | 0.49 | 0.279 | 0.36 | 1.29 | 1.82 |
| 12 | SAP5 | 50/60 | 0.40 | 2.11 | 0.74 | 0.279 | 0.28 | 1.00 | 2.13 |
| 13 | SAP7 | 70/80 | 0.37 | 2.81 | 0.49 | 0.279 | 0.20 | 0.72 | 1.85 |
| 14 | SAP7 | 80/100 | 0.37 | 2.55 | 0.49 | 0.279 | 0.17 | 0.61 | 1.65 |

TABLE 5

| Example | Mineral | Make add-on ($kg/m^2$) | Mineral add-on ($kg/m^2$) | Size add-on ($kg/m^2$) | Fiber Diameter (mm) | Average Particle Size (mm) | Ratio | Cut, g |
|---|---|---|---|---|---|---|---|---|
| Comp. A | AP1 | 0.41 | 2.29 | 0.56 | 0.381 | 0.84 | 2.20 | 1.05 |
| Comp. B | AP2 | 0.46 | 1.64 | 0.31 | 0.381 | 0.84 | 1.27 | 0.81 |
| Comp. C | AP3 | 0.45 | 1.52 | 0.46 | 0.381 | 0.84 | 0.73 | 1.12 |
| Comp. D | AP4 | 0.46 | 1.70 | 0.3 | 0.381 | 0.84 | 0.53 | 1.02 |
| Comp. E | AP5 | 0.39 | 2.34 | 0.51 | 0.381 | 0.84 | 0.33 | 1.10 |
| Comp. F | AP6 | 0.41 | 2.14 | 0.56 | 0.381 | 0.84 | 0.20 | 0.89 |

Examples 15-20

The abrasive articles of Example 15 through Example 20 were prepared using a nonwoven web having 200 denier (ca. 160 μm diameter) staple fibers and shaped abrasive particles of various sizes.

Example 15

A nonwoven web was formed on an air laid fiber web forming machine, available under the trade designation "RANDO-WEBBER" from the Rando Machine Corporation of Macedon, N.Y. The fiber web was formed from 200 denier nylon crimp set fiber with a staple length of 2.1 inches. The weight of the web was approximately 130 grains/24 $in^2$ (0.544 $kg/m^2$). The binder resin coating contained the ingredients shown in Table 6 and was applied via a 2-roll coater. The web was conveyed to a horizontal, two-roll coater, where a prebond resin was applied to get a dry add-on weight of 96 grains/24 $in^2$ (0.402 $kg/m^2$). The prebond resin was cured to a non-tacky condition by passing the coated web through a convection oven at 174° C. for 7 minutes, yielding a prebonded, nonwoven web of approximately 0.84 inches (2.14 cm) thickness and having a basis weight of 226 grains/24 $in^2$ (0.946 $kg/m^2$).

TABLE 6

| Prebond Resin Components | % of Component |
|---|---|
| BL-16 | 40.9% |
| Solvent | 23.1% |
| K-450 | 15.0% |
| PMX | 3.6% |
| Calcium Carbonate | 16.4% |
| VM | 1.0% |

The dried web thus formed was later converted to an abrasive composition by applying a make resin coating, mineral coating, and size coating. The make resin coating contained the ingredients shown in Table 2 and was applied via a 2-roll coater. Following the application of the binder resin coating to achieve about 107.4 grains/24 $in^2$ (0.45 $kg/m^2$) dry add-on, SAP 2 was then applied to the resin coated web via a drop coater to achieve an add-on of 565 grains/24 $in^2$ (2.37$kg/m^2$). The composition was then passed through a curing oven heated at 174° C. to provide a residence time of about 6 minutes to substantially cure the binder resin.

A size coating of the composition shown in Table 3 was then sprayed on the top side of the composition and heated in an oven for 6 minutes at 163° C. The composition was inverted and the other side sprayed with an identical amount of the size coating and heated in an oven for 6 minutes at 163° C. The final size coating dry add-on was about 129.7 grains/24 $in^2$ (0.54 $kg/m^2$). The resulting composition had a thickness of 0.850 in (2.16 cm) and weighed 1022 grains/24 $in^2$ (4.277 $kg/m^2$). These compositions were then converted into wheels with a diameter of 4 in (10.16 cm) and a center hole of 0.5 in (1.27 cm) for testing according to the Cut Test.

Example 16

The abrasive article of Example 16 was prepared using the procedure described for Example 15 except a make coat add-on of 107 grains/24 $in^2$ (0.45 $kg/m^2$), SAP2 was replaced by SAP3 and applied to achieve an abrasive particle coating weight of 614 grains/24 $in^2$ (2.53 $kg/m^2$), and the final size coating dry add-on was about 128 grains/24 $in^2$ (0.54 $kg/m^2$).

Example 17

The abrasive article of Example 17 was prepared using the procedure described for Example 15 except a make coat add-on of 107 grains/24 $in^2$ (0.45 $kg/m^2$), SAP2 was replaced by SAP4 and applied to achieve an abrasive particle coating weight of 555 grains/24 $in^2$ (2.32 $kg/m^2$), and the final size coating dry add-on was about 132 grains/24 $in^2$ (0.55 $kg/m^2$).

Example 18

The abrasive article of Example 18 was prepared using the procedure described for Example 15 except a make coat add-on of 107 grains/24 $in^2$ (0.45 $kg/m^2$), SAP2 was replaced by SAP5 and applied to achieve an abrasive particle coating weight of 642 grains/24 $in^2$ (2.68 $kg/m^2$), and the final size coating dry add-on was about 130 grains/24 $in^2$ (0.54 $kg/m^2$).

Example 19

The abrasive article of Example 19 was prepared using the procedure described for Example 15 except a make coat add-on of 107 grains/24 $in^2$ (0.45 $kg/m^2$), SAP2 was replaced by SAP6 and applied to achieve an abrasive particle coating weight of 568 grains/24 $in^2$ (2.37 $kg/m^2$), and the final size coating dry add-on was about 133 grains/24 $in^2$ (0.56 $kg/m^2$).

Example 20

The abrasive article of Example 20 was prepared using the procedure described for Example 15 except a make coat add-on of 107 grains/24 $in^2$ (0.45 $kg/m^2$), SAP2 was replaced by SAP7 and applied to achieve an abrasive particle coating weight of 560 grains/24 $in^2$ (2.34 $kg/m^2$), and the final size coating dry add-on was about 129 grains/24 $in^2$ (0.54 $kg/m^2$).

Examples 21-26

The abrasive articles of Example 21 through Example 26 were prepared using a nonwoven web having 500 denier (ca. 250 μm diameter) staple fibers and shaped abrasive particles of various sizes.

Example 21

A nonwoven web of Example 21 was formed similar to Example 15. The fiber web was formed from 500 denier nylon crimp set fiber with a staple length of 2.5 inches. The weight of the web was approximately 126 grains/24 $in^2$ (0.528 $kg/m^2$). The binder resin coating contained the ingredients shown in Table 6 and was applied via a 2-roll coater. The web was conveyed to a horizontal, two-roll coater, where a pre-bond resin was applied to get a dry add-on weight of 117 grains/24 $in^2$ (0.490 $kg/m^2$). The pre-bond resin was cured to a non-tacky condition by passing the coated web through a convection oven at 174° C. for 7 minutes, yielding a pre-bonded, nonwoven web of approximately 1.02 inches (2.59 cm) thickness and having a basis weight of 243 grains/24 in (1.017 $kg/m^2$).

The dried web thus formed was later converted to an abrasive composition by applying a make resin coating, mineral coating, and size coating. The make resin coating contained the ingredients shown in Table 2 and was applied via a 2-roll coater. Following the application of the make resin coating to achieve about 112 grains/24 $in^2$ (0.47 $kg/m^2$) dry add-on, SAP 2 was then applied to the resin coated web via a drop coater to achieve an add-on of 557 grains/24 $in^2$ (2.33$kg/m^2$). The composition was then passed through a curing oven heated at 174° C. to provide a residence time of about 6 minutes to substantially cure the binder resin.

A size coating of the composition shown in Table 3 was then sprayed on the top side of the composition and heated in an oven for 6 minutes at 163° C. The composition was inverted and the other side sprayed with an identical amount of the size coating and heated in an oven for 6 minutes at 163° C. The final size coating dry add-on was about 128 grains/24 $in^2$ (0.54 $kg/m^2$). The resulting composition had a thickness of 1.12 in (2.85 cm) and weighed 1048 grains/24 $in^2$ (4.3 87 $kg/m^2$). These compositions were then converted into wheels with a diameter of 4 in (10.16 cm) and a center hole of 0.5 in (1.27 cm) for cut testing according to the Cut Test.

Example 22

The abrasive article of Example 22 was prepared using the procedure described for Example 21 except a make coat add-on of 112 grains/24 $in^2$ (0.47 $kg/m^2$), SAP2 was replaced by SAP3 and applied to achieve an abrasive particle coating weight of 772 grains/24 $in^2$ (3.23 $kg/m^2$), and the final size coating dry add-on was about 130 grains/24 $in^2$ (0.54 $kg/m^2$).

Example 23

The abrasive article of Example 23 was prepared using the procedure described for Example 21 except a make coat add-on of 112 grains/24 $in^2$ (0.47 $kg/m^2$), SAP2 was replaced by SAP4 and applied to achieve an abrasive particle coating weight of 535 grains/24 $in^2$ (2.24 $kg/m^2$), and the final size coating dry add-on was about 128 grains/24 $in^2$ (0.54 $kg/m^2$).

Example 24

The abrasive article of Example 24 was prepared using the procedure described for Example 21 except a make coat add-on of 112 grains/24 $in^2$ (0.47 $kg/m^2$), SAP2 was replaced by SAP5 and applied to achieve an abrasive particle coating weight of 701 grains/24 $in^2$ (2.93 $kg/m^2$), and the final size coating dry add-on was about 131 grains/24 $in^2$ (0.55 $kg/m^2$).

Example 25

The abrasive article of Example 25 was prepared using the procedure described for Example 21 except a make coat add-on of 112 grains/24 $in^2$ (0.47 $kg/m^2$), SAP2 was replaced by SAP6 and applied to achieve an abrasive particle coating weight of 705 grains/24 $in^2$ (2.95 $kg/m^2$), and the final size coating dry add-on was about 130 grains/24 $in^2$ (0.54 $kg/m^2$).

Example 26

The abrasive article of Example 26 was prepared using the procedure described for Example 21 except a make coat add-on of 112 grains/24 $in^2$ (0.47 $kg/m^2$), SAP2 was replaced by SAP6 and applied to achieve an abrasive particle coating weight of 714 grains/24 $in^2$ (2.98 $kg/m^2$), and the final size coating dry add-on was about 130 grains/24 $in^2$ (0.54 $kg/m^2$).

Discussion of Test Results

The Cut Test results are shown in Table 7 for Example 15 through Example 20 and in Table 8 for Example 21 through Example 26. For each series of particle size:fiber size ratios, the cut exhibits a maximum in the specified particle size: fiber size ratio range.

TABLE 8

| Example | Mineral | Mesh Size (ASTM) | Make add-on ($kg/m^2$) | Mineral add-on ($kg/m^2$) | Size add-on ($kg/m^2$) | Fiber Diameter (mm) | SAP Average Size | Ratio | Cut |
|---|---|---|---|---|---|---|---|---|---|
| 21 | SAP2 | 16/20 | 0.47 | 2.33 | 0.53 | 0.25 | 1.02 | 4.08 | 0.60 |
| 22 | SAP3 | 30/50 | 0.47 | 3.23 | 0.54 | 0.25 | 0.45 | 1.80 | 1.07 |
| 23 | SAP4 | 40/50 | 0.47 | 2.24 | 0.54 | 0.25 | 0.36 | 1.44 | 0.98 |
| 24 | SAP5 | 50/60 | 0.47 | 2.93 | 0.55 | 0.25 | 0.28 | 1.12 | 0.94 |
| 25 | SAP6 | 70/80 | 0.47 | 2.91 | 0.55 | 0.25 | 0.20 | 0.80 | 0.90 |
| 26 | SAP7 | 80/100 | 0.47 | 2.95 | 0.54 | 0.25 | 0.17 | 0.68 | 0.79 |

TABLE 7

| Example | Mineral | Mesh Size (ASTM) | Make add-on ($kg/m^2$) | Mineral add-on ($kg/m^2$) | Size add-on ($kg/m^2$) | Fiber Diameter (mm) | SAP Average Size | Ratio | Cut |
|---|---|---|---|---|---|---|---|---|---|
| 15 | SAP2 | 16/20 | 0.45 | 2.36 | 0.54 | 0.16 | 1.02 | 6.46 | 0.41 |
| 16 | SAP3 | 30/50 | 0.45 | 2.56 | 0.53 | 0.16 | 0.45 | 2.85 | 0.64 |
| 17 | SAP4 | 40/50 | 0.45 | 2.32 | 0.55 | 0.16 | 0.36 | 2.28 | 1.12 |
| 18 | SAP5 | 50/60 | 0.45 | 2.68 | 0.54 | 0.16 | 0.28 | 1.77 | 1.35 |
| 19 | SAP6 | 70/80 | 0.45 | 2.37 | 0.56 | 0.16 | 0.20 | 1.27 | 0.96 |
| 20 | SAP7 | 80/100 | 0.45 | 2.34 | 0.54 | 0.16 | 0.17 | 1.08 | 0.90 |

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A nonwoven abrasive article comprising: a nonwoven web; and a binder adhering formed ceramic abrasive particles to fibers of the nonwoven web, the formed ceramic abrasive particles having a formed ceramic abrasive particle size and the fibers having a fiber diameter, the formed ceramic abrasive particles having at least a partially replicated shape, the formed ceramic abrasive particle size being an average particle size that corresponds to an industry specified grade or that is an average of the size of a smallest screen opening the formed ceramic particles pass through and the size of a largest screen opening the formed ceramic particles are retained on; wherein a ratio of the formed ceramic abrasive particle size to the nonwoven fiber diameter is from 0.5 to 2.25.

2. The nonwoven abrasive article of claim 1 wherein the fibers comprise staple fibers.

3. The nonwoven abrasive article of claim 1 wherein the fibers are continuous.

4. The abrasive article of claim 3 wherein the fibers comprise undulated fibers with adjacent fibers being interengaged and autogenously bonded where they touch one another.

5. The abrasive article of claim 1 wherein the formed ceramic abrasive particles comprise triangular shaped abrasive particles.

6. The abrasive article of claim 5 wherein the formed ceramic abrasive particle size is from 120-1020 micrometers.

7. The abrasive article of claim 1 wherein the ratio of the formed ceramic abrasive particle size to the nonwoven fiber diameter is from 0.7 to 1.5.

8. The abrasive article of claim 1, wherein the coating weight of the formed ceramic abrasive particle on the nonwoven web is at least 100 $g/m^2$.

9. The abrasive article of claim 1, wherein the coating weight of the formed ceramic abrasive particle on the nonwoven web is 600 $g/m^2$ to 3,230 $g/m^2$.

10. The abrasive article of claim 1, wherein the coating weight of the formed ceramic abrasive particle on the nonwoven web is 2,110 $g/m^2$ to 3,230 $g/m^2$.

11. The nonwoven abrasive article of claim 1, wherein the fibers of the nonwoven web comprise fibers having a non-circular cross-sectional shape.

12. A nonwoven abrasive article comprising:

a nonwoven web; and a binder adhering formed ceramic abrasive particles comprising triangular-shaped abrasive particles to fibers of the nonwoven web, the formed ceramic abrasive particles having a formed ceramic abrasive particle size and the fibers having a fiber diameter, the formed ceramic abrasive particles having at least a partially replicated shape, the formed ceramic abrasive particle size being an average particle size that corresponds to an industry specified grade or that is an average of the size of a smallest screen opening the formed ceramic particles pass through and the size of a largest screen opening the formed ceramic particles are retained on;

wherein a ratio of the formed ceramic abrasive particle size to the nonwoven fiber diameter is from 0.5 to 2.25; and wherein the nonwoven web is compressed from a first density to a second density.

13. The nonwoven abrasive article of claim 12 wherein the fibers comprise staple fibers.

14. The nonwoven abrasive article of claim 12 wherein the fibers are continuous.

15. The abrasive article of claim 14 wherein the fibers comprise undulated fibers with adjacent fibers being interengaged and autogenously bonded where they touch one another.

16. The abrasive article of claim 12 wherein the formed ceramic abrasive particle size is from 120-1020 micrometers.

17. The abrasive article of claim 12 wherein the fiber diameter is from 50 to 385 micrometers.

18. The abrasive article of claim 12 wherein the ratio of the formed ceramic abrasive particle size to the nonwoven fiber diameter is from 0.7 to 1.5.

19. The abrasive article of claim 12, wherein the coating weight of the formed ceramic abrasive particle on the nonwoven web is 2,110 $g/m^2$ to 3,230 $g/m^2$.

20. The nonwoven abrasive article of claim 12, wherein the fibers of the nonwoven web comprise fibers having a non-circular cross-sectional shape.

* * * * *